US005158361A

United States Patent [19]

Huang

[11] Patent Number: 5,158,361

[45] Date of Patent: Oct. 27, 1992

[54] STRUCTURE OF LAMP FRAME ASSEMBLY

[76] Inventor: Soddy Huang, No. 6, Alley, 9, Lane 77, Hsien Hsing St., Shulin, Taipei Hsien, Taiwan

[21] Appl. No.: 797,208

[22] Filed: Nov. 25, 1991

[51] Int. Cl.[5] ..... F21S 1/12

[52] U.S. Cl. ..... 362/414; 362/413; 362/401; 362/427

[58] Field of Search ..... 362/414, 382, 388, 396, 362/402, 401, 410, 413, 419, 427; 248/124, 121, 123, 280.1, 585

[56] References Cited

U.S. PATENT DOCUMENTS

| | | | |
|---|---|---|---|
| 1,642,367 | 9/1927 | Hand et al. | 362/402 X |
| 3,239,184 | 3/1966 | Kirkeby | 362/414 X |
| 4,494,177 | 1/1985 | Matthews | 362/414 X |
| 4,858,092 | 8/1989 | Lu | 362/413 |
| 5,016,153 | 5/1991 | Gismondi et al. | 362/414 X |
| 5,045,986 | 9/1991 | Lin | 362/413 |
| 5,050,054 | 9/1991 | Hsu | 362/413 X |
| 5,084,810 | 1/1992 | Haung | 362/414 X |

*Primary Examiner*—Larry Jones
*Attorney, Agent, or Firm*—Bacon & Thomas

[57] ABSTRACT

A lamp frame assembly comprising a base having a sleeve for connecting a supporting frame through a coupling device, and a lamp holder connected to said supporting frame by a connecting frame assembly which is connected between said lamp holder and said supporting frame by two locking devices through which the angular position of the connecting frame assembly relative to the lamp holder and the supporting frame can be adjusted by a hand lever. By changing the sleeve on the base, the lamp frame assembly can be set up into a desk lamp or floor lamp. The base can be a wall fixture which incorporates the supporting frame, the connecting frame assembly and the lamp holder into a wall lamp.

3 Claims, 6 Drawing Sheets

STRUCTURE OF LAMP FRAME ASSEMBLY

BACKGROUND OF THE INVENTION

The present invention relates to a lamp frame assembly and relates more particularly to such a lamp frame assembly which can be conveniently set up into a desk lamp, a floor lamp or a wall lamp.

According to conventional manufacturing methods, a lamp is specifically designed for a single purpose. Once a lamp is made, it is specifically provided for use as a desk lamp, a floor lamp or a wall lamp. The present invention is designed to provide a lamp frame assembly which can be conveniently alternatively set up into a desk lamp, a floor lamp or a wall lamp. According to the present invention, a lamp frame assembly is generally comprised of a base, a supporting frame connected to said base by a coupling device, a connecting frame assembly angularly adjustably connected to said supporting frame at an opposite end by a locking device, and a lamp holder angularly adjustable connected to said connecting frame assembly at an opposite end by a locking device. The base has a sleeve for fastening the coupling device the length of which is determined according to the purpose of the lamp frame assembly, i.e. a short sleeve is made on the base for connecting the coupling device so that the lamp frame assembly is set up into a desk lamp, or an elongated sleeve is made on the base for connecting the coupling device so that the lamp frame assembly is set up into a floor lamp. Further, the base can be a wall fixture which incorporates the supporting frame, the connecting frame assembly and the lamp holder into a wall lamp.

DETAILED DESCRIPTION OF THE PREFERRED EMBODIMENTS

Figure 1:
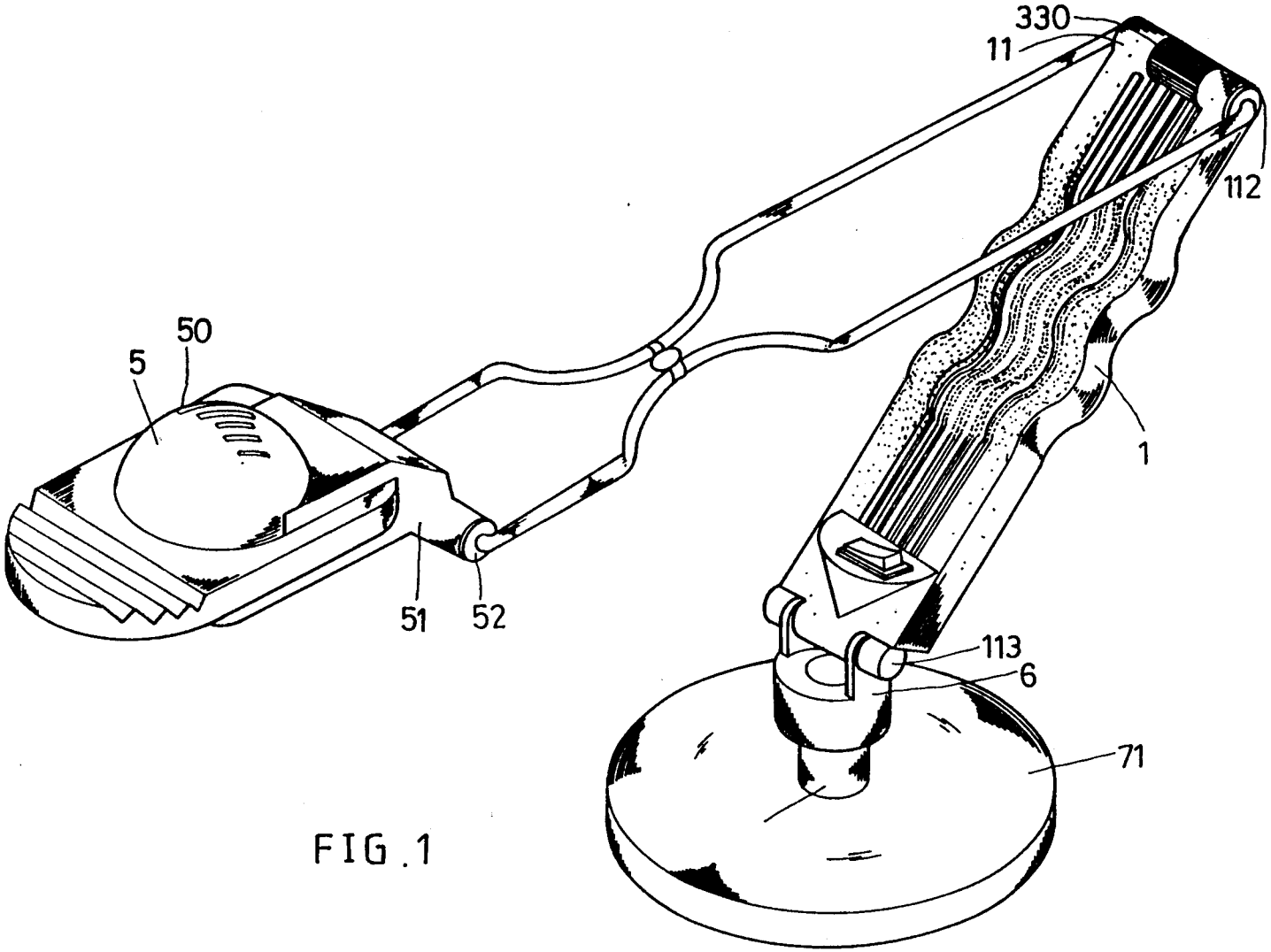
FIG. 1 is an elevational view of a lamp frame assembly embodying the present invention.
Figure 2:
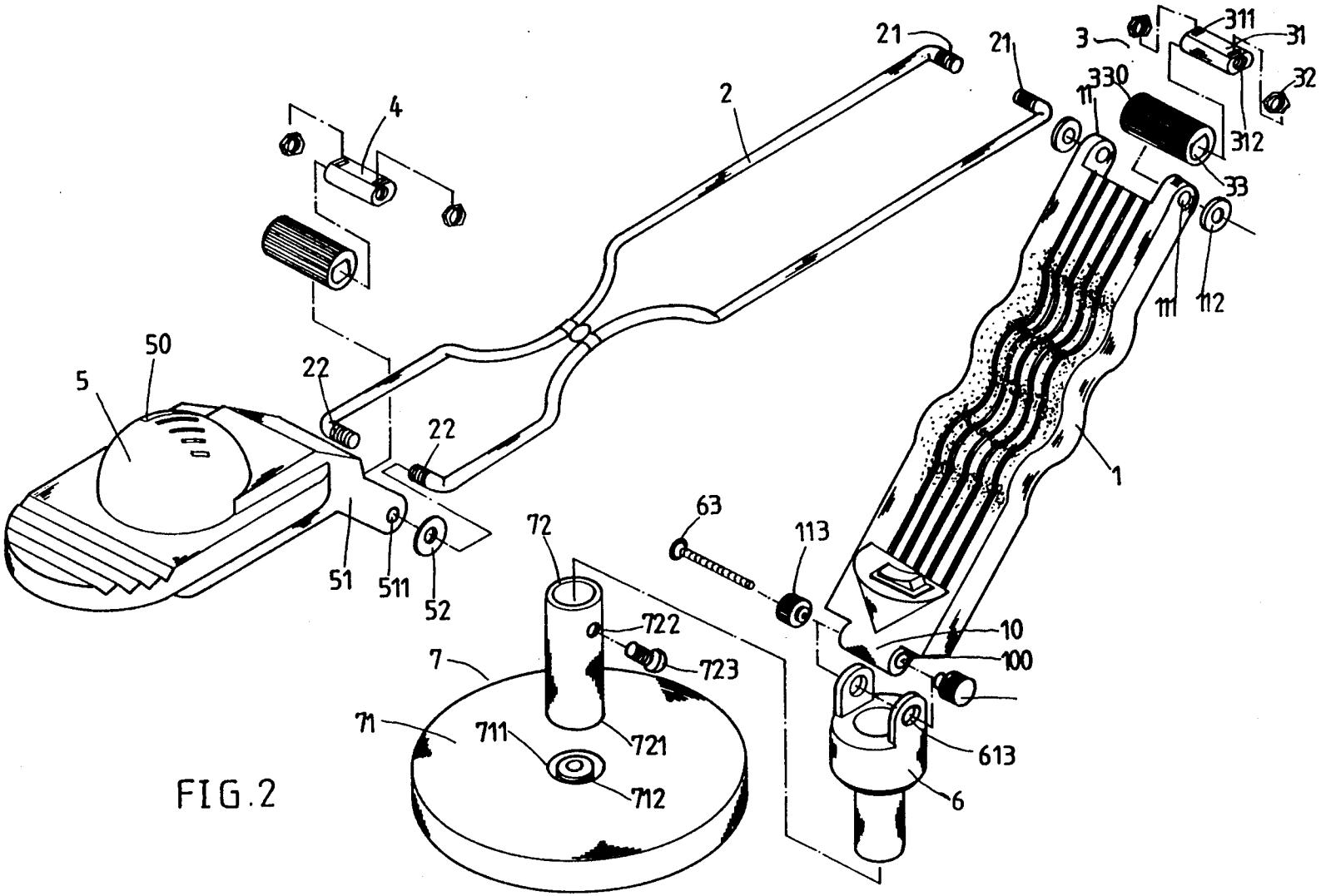
FIG. 2 is an exploded perspective view thereof.
Figure 3A:
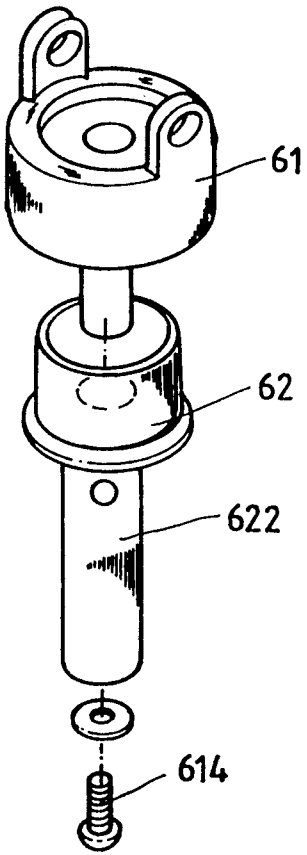
FIG. 3*a* is an elevational view of the mounting member.
Figure 3B:
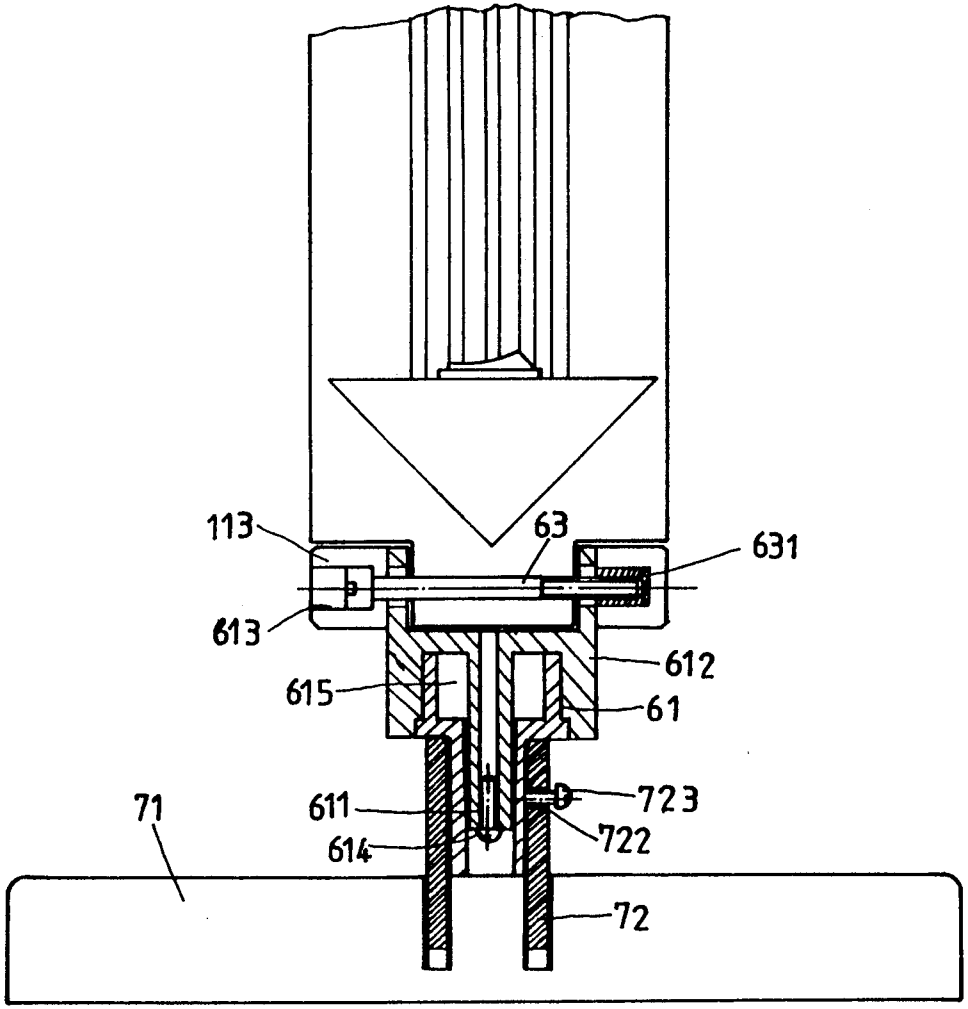
FIG. 3 is a sectional assembly view of the mounting member thereof.

Referring to the FIGS. 1, 2 and 3, a lamp frame assembly in accordance with the present invention is generally comprised of a supporting frame 1, a connecting frame assembly 2, two locking devices 3 and 4, a lamp holder 5, a coupling device 6 and a base 7.

The supporting frame 1 has two lugs 11 at one end each of which has a round hole 111 pierced therethrough in transverse direction for connecting the connecting frame assembly 2 and the first locking device 3, and a plurality of hinge barrels 113 aligned at an opposite end for connecting the coupling device 6. The connecting frame assembly 2 which is formed of two elongated rods bent into shape and symmetrically connected together comprises two opposite pairs of unitary screw rods 21 and 22, or 21' and 22' respectively bent inwards at right angles at two opposite ends. The locking device 3 or 4 comprises a lock barrel 31 set inside an insulator sleeve 33, which lock barrel 31 has two rectangular holes 311 at two opposite ends with two nuts 32 set therein respectively therein. The insulator sleeve 33 conceals the nuts 32 and has embossed stripes 330 on the outer surface thereof for positive grip. By inserting the first pair of screw rods 21, 21' of the connecting frame assembly 2 through two rubber rings 112 and the round holes 111 of the two lugs 11 of the supporting frame 1 into the two nuts 32, the supporting frame 1, the first locking device 3 and the connecting frame assembly 2 are connected together. The lamp holder 5 has two stub tubes 51 bilaterally extending outwards at one end and longitudinally aligned with each other each of which has a round hole 511 for connecting the second pair of screw rods 22 and 22' of the connecting frame assembly 2, and the second locking device 4. Further, the lamp holder 5 has a plurality of slots 50 for dissipating heat. The connecting frame assembly 2, the second locking device 4 and the lamp holder 5 are connected together through the same procedure as performed in connecting the connecting frame assembly 2, the first locking device 3 and the supporting frame 1. Before inserting through the round hole 511 on either stub tube 51, each screw rod 22 or 22' is inserted through rubber ring 52. The coupling device 6 is comprised of a movable member 61, a fixed member 62 and a screw rod 63. As illustrated in FIG. 3, the movable member 61 has two opposite lugs 612 at the top each of which has a round hole 613 with a copper nut 631 set therein. The screw rod 63 in inserted through the hinge barrels 113 to secure the coupling device 6 to the supporting frame 1. The movable member 61 has a vertical rod 611 at the bottom inserted in a round hole 621 on the fixed member 62 and secured therein by a screw 614. The movable rod 61 further comprises a cylindrical chamber 615 around the vertical rod 611 for inserting the fixed member 62. The fixed member 62 has a vertical rod 622 at the bottom fixedly secured to the base 7. The base 7 comprises a sleeve 72 vertically fastened in the body 71 thereof at the center The body 71 of the base 7 has an annular groove 711 at the center defining therein a unitary stub screw rod 712. The sleeve 72 has an inner thread 721 tightly screwed up with the stub screw rod 712, and a bolt hole 722 on the outer wall adjacent to the top edge thereof through which a screw 723 is inserted to secure the fixed member 62 of the coupling device 6 thereof.

As indicated, by screw up the inner thread 721 of the sleeve 72 with the the stub screw rod 712, the sleeve 72 is secured to the body 71. Then, insert the screw rod 63 in the hinge barrels 113 with its two opposite ends respectively fastened in the two copper nuts 631, which are set inside the two round holes 613 on the two lugs 612 of the movable member 61, permitting the fastening device 6 to be pivoted to the supporting frame 1. Then, the vertical rod 622 of the fixed member 62 is inserted in the sleeve 72 of the base 7 and secured in place by the screw 723. Then, the lamp holder 5 is connected to the connecting frame assembly 2 and the second locking device 4, and the connecting frame assembly 2 is connected to the supporting frame 1 and the first locking device 3 according to aforesaid procedure.

Figure 4:
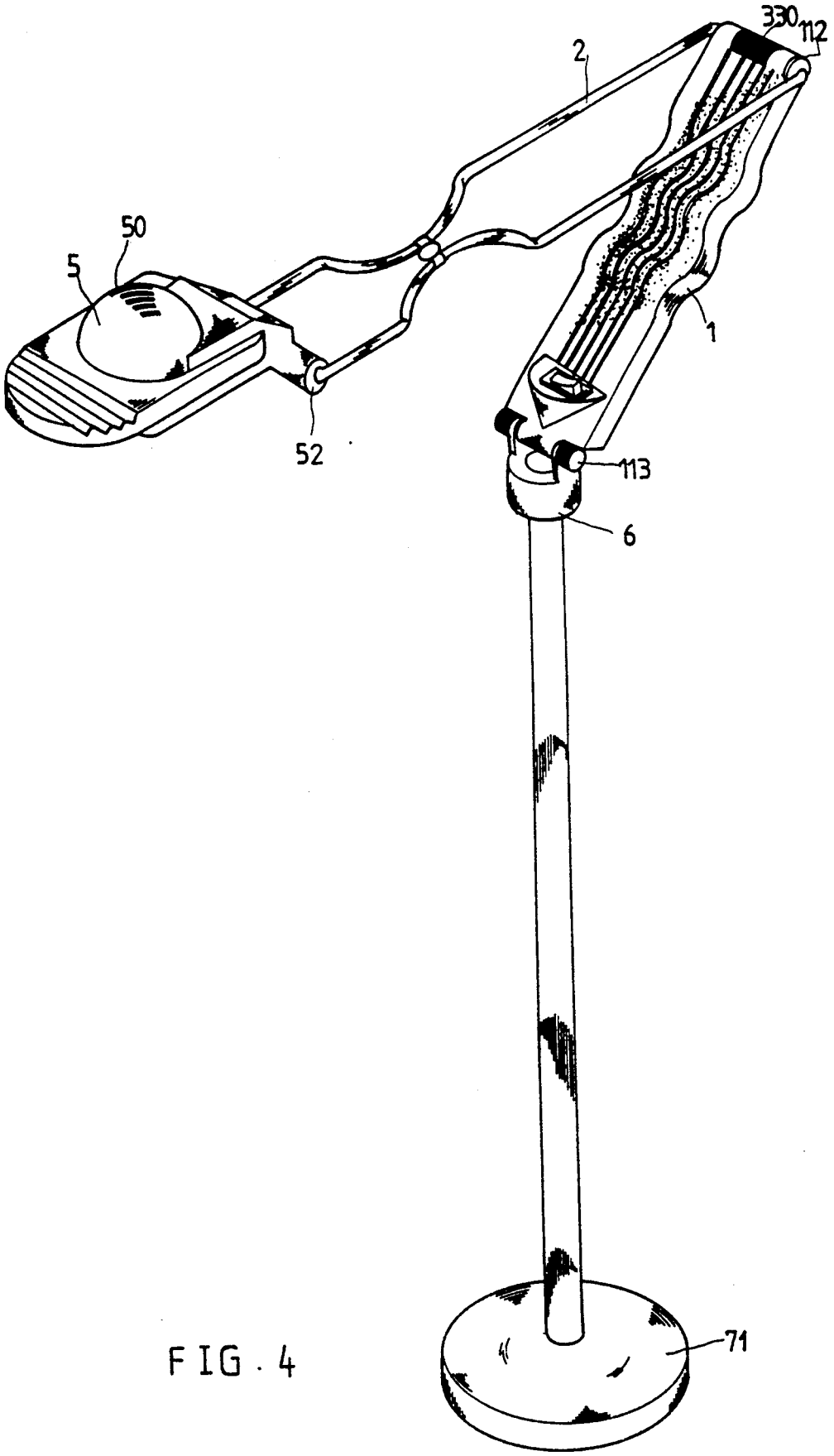
FIG. 4 illustrates an application of the present invention in which it is sued as the frame for a floor lamp.
Figure 5:
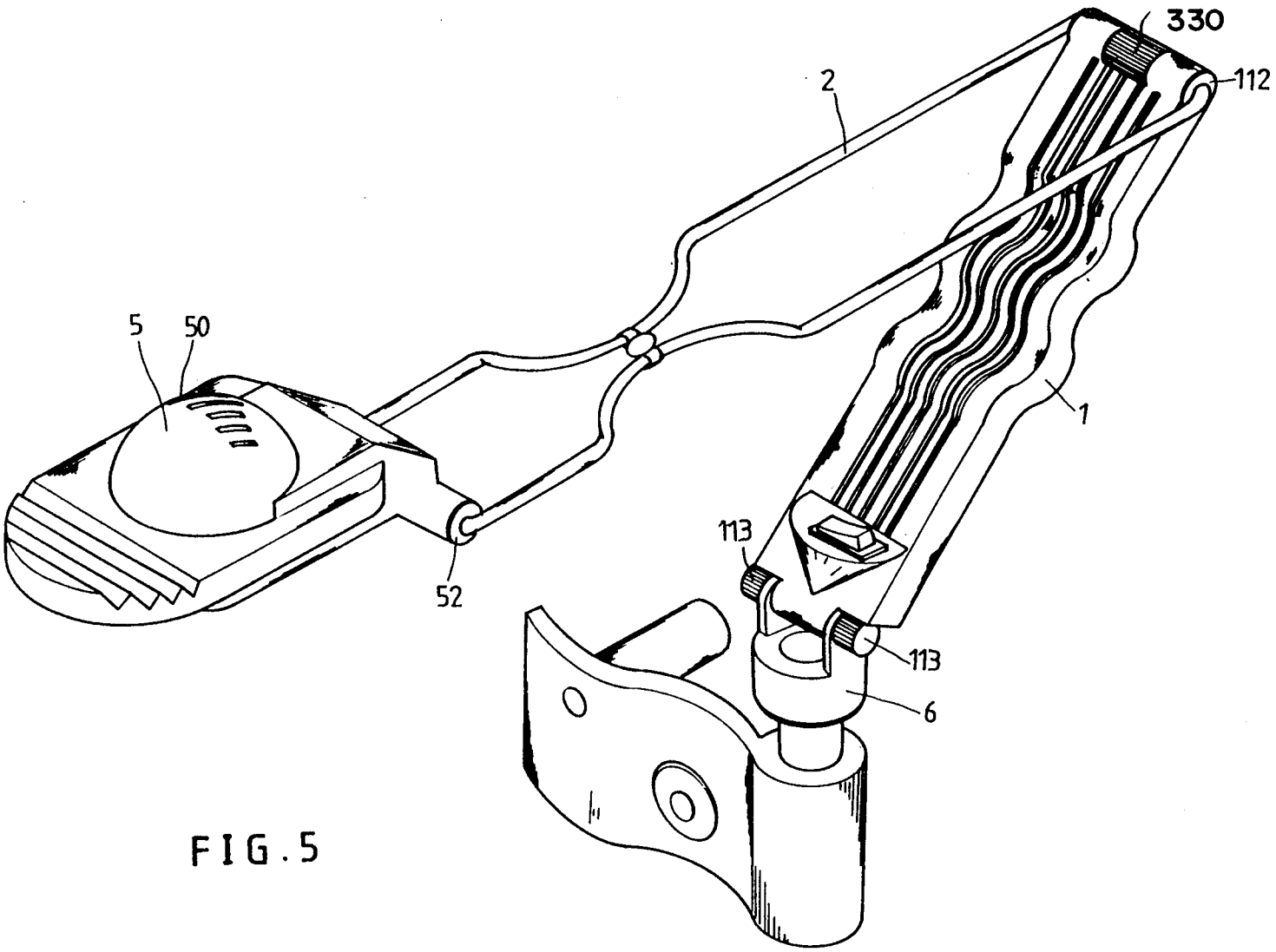
FIG. 5 illustrates another application of the present invention in which it is used as the frame for a wall lamp.

When an elongated sleeve is used to connect the coupling device 6 to the base 7, the present invention can set up into a floor lamp as shown in FIG. 4. In another alternate form of the present invention, a wall fixture may be used to replace the base 7 so that the present invention can be set up into a wall lamp.

What is claimed is:

1. A lamp frame assembly comprising:

a supporting frame having two opposite, eyes lugs at one end, and a plurality of hinge barrels aligned at an opposite end;

a connecting frame assembly having two opposite pairs of unitary screw rods respectively bent inwards at right angles at two opposite ends;

a lamp holder connected to said connecting frame at one end, said lamp holder having two stub tubes bilaterally extending outwards at one end and longitudinally aligned with each other, said two stub tubes each having a round hole for inserting either pair of the unitary screw rods of said connecting frame;

two locking devices for securing said lamp holder and said supporting frame to said connecting frame assembly at two opposite ends, each of which comprising a lock barrel set inside an insulator sleeve, said lock barrel having two rectangular holes at two opposite ends with two nuts set therein respectively for fastening either pair of the unitary screw rods of said connecting frame assembly;

a base comprising a body having a sleeve; and a coupling device for connecting said supporting frame to the sleeve of said base, said coupling device comprising a movable member and a fixed member, said movable member having two opposite, eyed lugs at the top with two nuts respectively set therein for connecting to said hinge barrels by a screw rod, a vertical rod at the bottom inserted in a round hole on said fixed member and secured therein by a screw, and a cylindrical chamber around the vertical rod thereof for inserting said fixed member, said fixed member having a vertical rod at the bottom secured in the sleeve on said base by a lock screw.

2. The lamp frame assembly of claim 1, wherein said base comprises a body having an elongated sleeve vertically disposed at the center for connecting said coupling device permitting said lamp holder, said connecting frame assembly and said supporting frame to be incorporated thereto into a floor lamp, said body having an annular groove at the center defining therein a unitary stub screw rod for connecting said elongated sleeve through screw joint.

3. The lamp frame assembly of claim 1, wherein said base is a wall fixture for fastening said coupling device on a wall permitting said lamp holder, said connecting frame assembly and said supporting frame to be incorporated thereto into a wall lamp.

* * * * *